US009010752B2

(12) United States Patent
Nawa

(10) Patent No.: US 9,010,752 B2
(45) Date of Patent: Apr. 21, 2015

(54) IMAGE FORMING APPARATUS

(71) Applicant: Canon Finetech Inc., Misato-shi, Saitama-ken (JP)

(72) Inventor: Satoshi Nawa, Funabashi-shi (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 13/864,504

(22) Filed: Apr. 17, 2013

(65) Prior Publication Data

US 2013/0294805 A1 Nov. 7, 2013

(30) Foreign Application Priority Data

May 1, 2012 (JP) ..... 2012-104363
Feb. 21, 2013 (JP) ..... 2013-032136

(51) Int. Cl.
*B65H 31/00* (2006.01)
*G03G 15/00* (2006.01)
*G03G 21/20* (2006.01)

(52) U.S. Cl.
CPC ..... *G03G 15/6582* (2013.01); *G03G 15/6552* (2013.01); *G03G 15/6573* (2013.01); *G03G 21/206* (2013.01)

(58) Field of Classification Search
CPC ..... G03G 15/6552; G03G 15/6573
USPC ..... 271/207; 399/92, 405
See application file for complete search history.

(56) References Cited

U.S. PATENT DOCUMENTS

| | | | | |
|---|---|---|---|---|
| 6,141,512 | A * | 10/2000 | Nagano et al. | 399/92 |
| 6,438,339 | B1 * | 8/2002 | Kaiho | 399/92 |
| 7,603,050 | B2 * | 10/2009 | Kim | 399/92 |
| 8,396,382 | B2 * | 3/2013 | Mori et al. | 399/43 |
| 2010/0329726 | A1 * | 12/2010 | Kasuga | 399/92 |

FOREIGN PATENT DOCUMENTS

| | | |
|---|---|---|
| JP | 11-212433 | 6/1999 |
| JP | 2001-242769 A | 9/2001 |
| JP | 2007-065404 A | 3/2007 |
| JP | 2010-054834 A | 3/2010 |

OTHER PUBLICATIONS

Office Action dated Jan. 6, 2015, in Japanese Patent Application No. 2013-032136.

* cited by examiner

*Primary Examiner* — Luis A Gonzalez
(74) *Attorney, Agent, or Firm* — Fitzpatrick, Cella, Harper & Scinto

(57) ABSTRACT

An object of the present invention is to cool a sheet discharged onto an output sheet stacking surface while keeping the sheet from floating up.

11 Claims, 11 Drawing Sheets

IMAGE FORMING APPARATUS

BACKGROUND OF THE INVENTION

1. Field of the Invention

The present invention relates to an image forming apparatus having a function to cool sheets on which toner images are formed.

2. Description of the Related Art

Conventionally, there is an image forming apparatus which forms toner images on sheets using an image forming section, heats the sheets and fixes the toner images on the sheets using a fixing device, and discharges the sheets onto a sheet stacking section using a discharge section (Japanese Patent Application Laid-Open No. H11-212433). The sheets discharged from the discharge section are discharged onto the sheet stacking section, which serves as a sheet stacking unit, in a short time after being heated by the fixing device. Therefore, toner of the toner images may fail to cool and solidify in some cases. In such cases, the toner acts as a sort of adhesive, bonding the sheets piled up on the sheet stacking section to each other.

Thus, the image forming apparatus described in Japanese Patent Application Laid-Open No. H11-212433 blows air directly at the sheets from a side of the sheets when the sheets are being discharged and loaded onto the sheet stacking section, and thereby cools the sheets together with the toner of the toner images to prevent the sheets from being bonded to each other on the sheet stacking section.

However, the conventional image forming apparatus cools the sheets together with the toner of the toner images by blowing air directly at the sheets from a side of the sheets when the sheets are being discharged and loaded onto the sheet stacking section. Consequently, the conventional image forming apparatus tends to blow off sheets of lightweight, plain or thin paper rather than thick paper, making it difficult to load the sheets onto the sheet stacking section by neatly aligning the sheets.

The present invention provides an image forming apparatus having a function to cool hot sheets without blowing off the sheets loaded onto a sheet stacking unit.

SUMMARY OF THE INVENTION

An image forming apparatus according to the present invention includes a discharge unit adapted to discharge a sheet with a toner image fixed thereon by heat; a sheet stacking unit on which the sheet discharged from the discharge unit is loaded; a ceiling configured to face the sheet stacking unit from above; and an air blowing unit adapted to blow air at the ceiling.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An image forming apparatus according to an embodiment of the present invention will be described below with reference to the drawings.

(Image Forming Apparatus According to First Embodiment)

Figure 1:
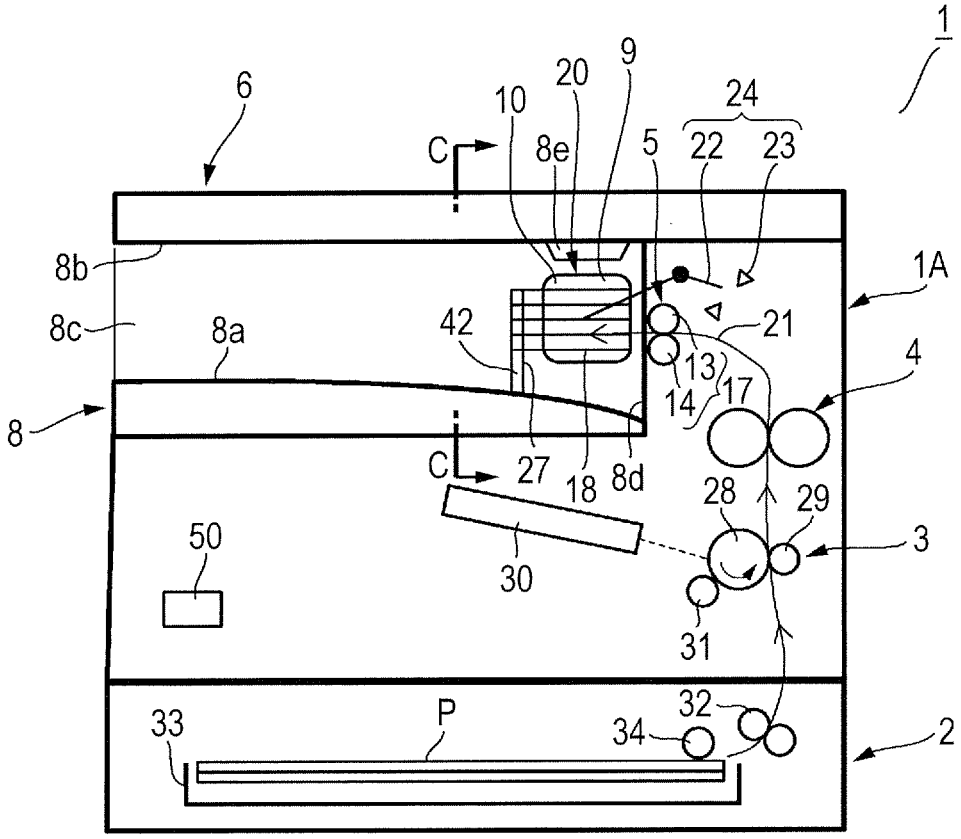
FIG. 1 is a schematic sectional view of an image forming apparatus according to a first embodiment of the present invention along a sheet conveying direction.

FIG. 1 is a schematic sectional view of an image forming apparatus according to a first embodiment of the present invention along a sheet conveying direction.

The image forming apparatus 1 is designed to form a toner image on a sheet based on image information about an original (not shown) scanned by an image scanner 6 or on image information transmitted from outside.

The image forming apparatus 1 has a paper feeding section 2, an image forming section 3, a fixing device 4, a discharge section 5, an output sheet cooling section 20, an output sheet stacking section 8, the image scanner 6 and the like in an apparatus body 1A.

The paper feeding section 2 is designed to feed sheets P to the image forming section 3. A pickup roller 34 of the paper feeding section 2 sends out the sheets P from a cassette 33 attachable/detachable with respect to the apparatus body 1A by rotationally coming into and out of contact with the sheets P loaded onto the cassette 33 and feeds the sheets P to a paper feed roller pair 32. The paper feed roller pair 32 feeds the sheets from the pickup roller 34 to the image forming section 3.

The image forming section 3 serving as an image forming unit is designed to form a toner image on each sheet fed from the paper feeding section 2. The image forming section 3 receives image information about an original (not shown) scanned by the image scanner 6 or image information transmitted from outside, using a laser unit 30. The laser unit 30 irradiates a charged, rotating photosensitive drum 28 with a laser beam and thereby forms a latent image corresponding to the image information. A developing device 31 carries out toner development to visualize the latent image with toner. A transfer roller 29, which has been charged, receives the sheet fed from the paper feeding section 2 in a nip formed by the transfer roller 29 and photosensitive drum 28 and transfers the toner image from the photosensitive drum 28 to the sheet by rotating together with the photosensitive drum 28.

The fixing device 4 serving as a fixing unit heats (or may heat under pressure) the sheet fed from the image forming section 3 and thereby fixes the toner image on the sheet. The discharge section 5 discharges the sheet to the output sheet stacking section 8. The output sheet cooling section 20 cools the output sheet discharged to the output sheet stacking section 8 by blowing air at the output sheet. By this, the image forming apparatus 1 finishes the operation of forming images on sheets.

Next, configurations of the discharge section 5, output sheet stacking section 8 and output sheet cooling section 20 will be described.

The discharge section 5 serving as a discharge unit guides a sheet on which a toner image has been fixed by the fixing device 4 along a discharge route 21 (FIG. 1 and FIG. 2B) to a discharge roller pair 17, which then discharges the sheet onto the output sheet stacking section 8. The discharge route 21 (FIG. 2B) is made up of an upper guide 15 and lower guide 16. The discharge roller pair 17, which are made up of an upper roller 13 and lower roller 14, serves as a sheet discharge port of the image forming apparatus 1.

A flag 22 configured to rotate by being pushed by the sheet discharged by the discharge roller pair 17 is installed downstream of the discharge roller pair 17 of the discharge section 5. The flag 22 is designed to turn in a direction in which the discharge roller pair 17 discharges the sheet. A sensor 23 adapted to sense turning of the flag 22 is installed in a turning area of the flag 22. The flag 22 and sensor 23 make up a sheet detecting section 24 serving as a detecting unit adapted to detect the output sheet discharged onto the output sheet stacking section 8. Sensors available for use as the sensor 23 include a through-beam sensor adapted to sense the flag 22 when the flag 22 blocks light and a contact sensor adapted to sense the flag 22 upon contact with the flag 22.

The output sheet stacking section 8 serving as a sheet stacking unit is formed by an output sheet stacking surface 8*a*, ceiling 8*b* and back wall 8*c* into a concave shape in the apparatus body, where the output sheet stacking surface 8*a* is loaded with the output sheets discharged from the discharge section 5, the ceiling 8*b* faces the output sheet stacking surface at a distance from the output sheet stacking surface, and the back wall 8*c* is formed between the ceiling and the output sheet stacking surface. The image forming apparatus 1 is a so-called internal output type. The ceiling 8*b* also serves as a bottom of the image scanner 6. The output sheet stacking surface 8*a* (FIG. 2B) serving as a sheet stacking surface is an inclined surface sloping downward toward the discharge section 5. A stopper wall 8*d* is formed on that side of the discharge section 5 of the output sheet stacking surface 8*a* which is closer to the discharge section 5 to stack the sheets sliding toward the discharge section 5 along the slope of the output sheet stacking surface 8*a* after being discharged onto the output sheet stacking surface 8*a*.

Plural ridges 8*e*, serving as projections provided with a triangular cross section and configured to project toward the output sheet stacking surface 8*a*, are formed successively on the ceiling 8*b* of the output sheet stacking section 8. Being provided with reflecting surfaces 8*ea* inclined with respect to the ceiling 8*b* and adapted to guide (reflect) air (described later) directed at the ceiling 8*b*, toward the output sheet stacking surface 8*a*, the ridges 8*e* serve as an air guide. The ridges 8*e* are installed along a discharge direction of the sheets (direction which intersects a discharge direction of the air described later) discharged from the discharge section 5 and are placed in the discharge direction of the air.

Figure 2A:
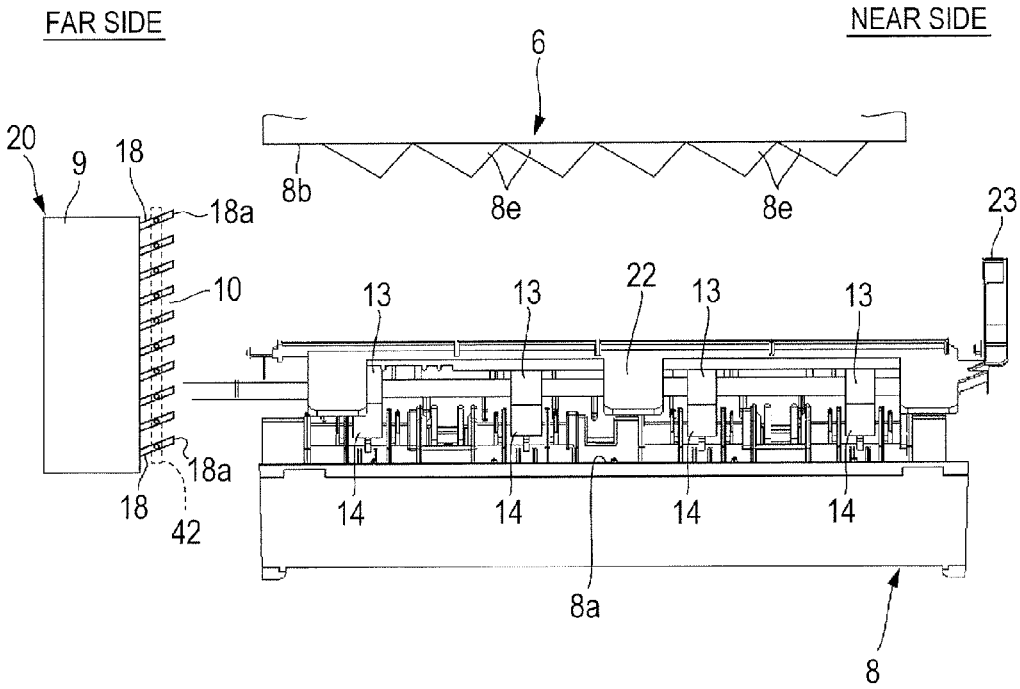
FIG. 2A is a sectional arrow view taken in the direction of line C-C in FIG. 1 when no sheet is sent to an output sheet stacking section in the image forming apparatus of FIG. 1.
Figure 2B:
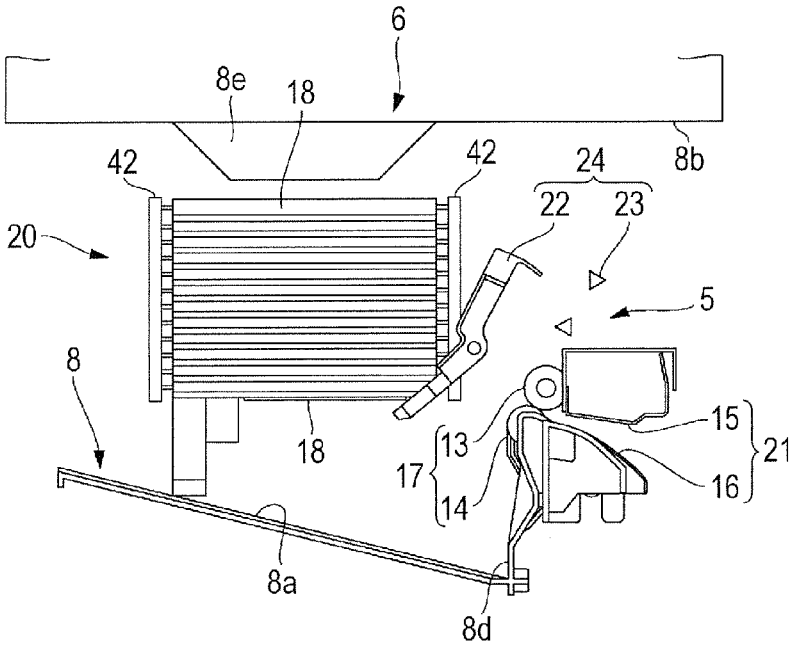
FIG. 2B is a right side view of FIG. 2A and a partially enlarged view of an output sheet cooling section in FIG. 1.

In FIGS. 1, 2A and 2B, the output sheet cooling section 20 serving as an air blowing unit is installed on the back wall 8*c* and designed to air-cool the sheets discharged onto the output sheet stacking surface 8*a* of the output sheet stacking section 8. Incidentally, although the back wall 8*c* is formed up to the left end of the apparatus body 1A in FIG. 1, the back wall 8*c* may be formed only where a blower fan 9 and baffles 18 of the output sheet cooling section 20 are installed.

The output sheet cooling section 20 is equipped with the blower fan 9 as well as the baffles 18 serving as flow guide members adapted to direct the air from the blower fan 9 toward the ceiling 8*b* of the output sheet stacking section 8. Incidentally, as a flow guide member adapted to direct the air from the blower fan 9 toward the ceiling 8*b* of the output sheet stacking section 8, a duct not so long as to get in the way of the sheets may be used instead of the baffles 18.

The blower fan 9 is installed on a near-side surface (front face) of the back wall 8*c* and designed to send air, between the ceiling 8*b* and the output sheet stacking surface 8*a*, from the far side to the near side of the output sheet stacking section 8.

A plurality of the baffles 18 are disposed (or a single baffle may be disposed) in a vertical direction on a front face (on the near side) of the blower fan 9 along the discharge direction of the sheets in the discharge section 5. The baffles 18 are rectangular plate members. Opposite ends of the baffles 18 are fixed to a pair of pillars 42 which face each other. The baffles 18 are fixed to the pillars 42 with front ends 18*a* in FIGS. 2A and 2B tilting upward such that the air from the blower fan 9 will be blown against the ceiling 8*b*. Front faces of the baffles 18 form air outlets 10 serving as air discharge ports. The pillars 42 are installed on the back wall 8*c*.

The paper feeding section 2, image forming section 3, fixing device 4, discharge section 5, output sheet cooling section 20 and image scanner 6 described above are designed to operate under the control of a control section 50 (FIG. 1).

Figure 5:
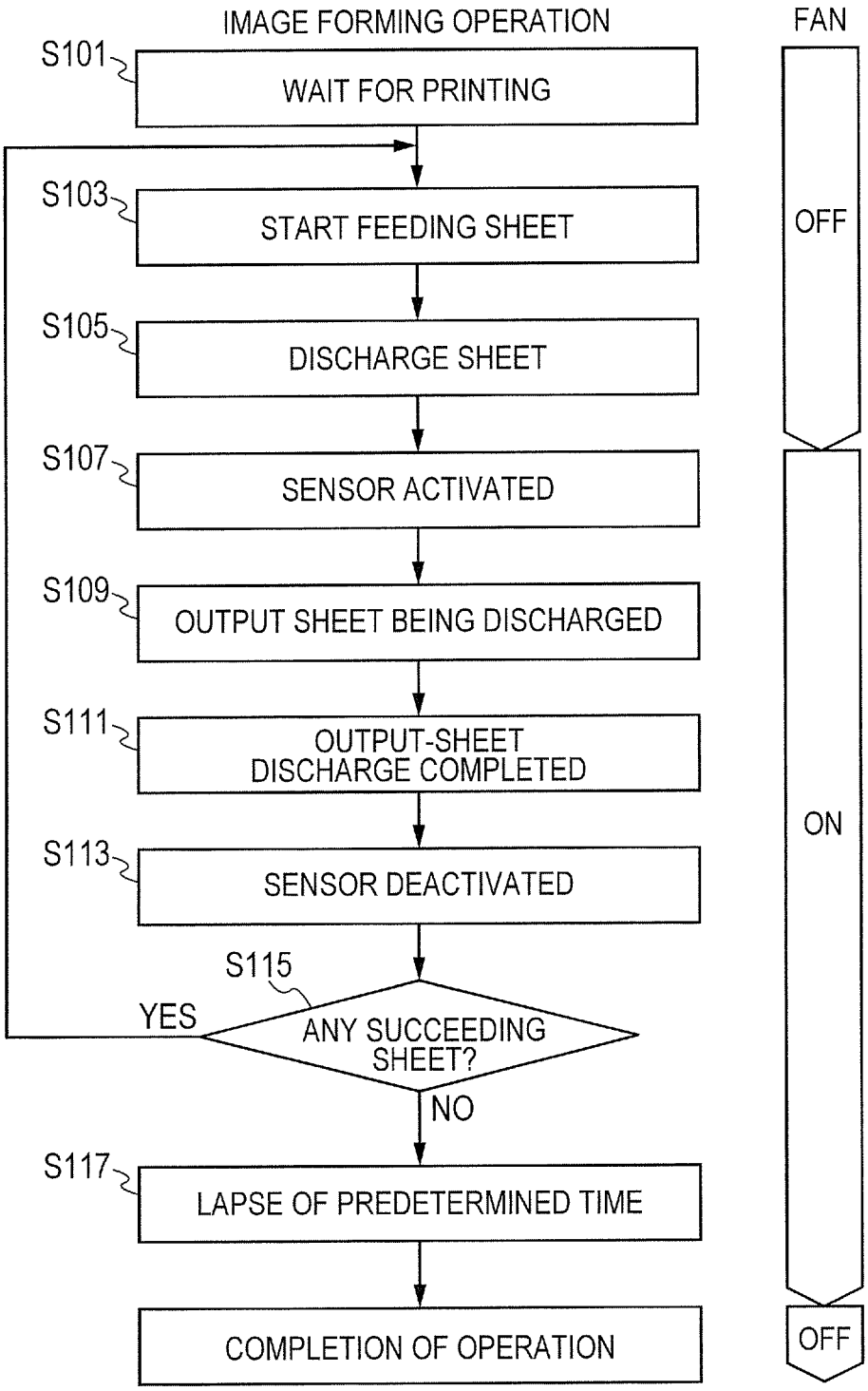
FIG. 5 is a flowchart for describing operation of the image forming apparatus shown in FIG. 1.

Next, operations of the discharge section 5, output sheet cooling section 20 and sheet detecting section 24 will be described mainly with reference to a flowchart in FIG. 5.

As shown in FIGS. 2A and 2B, the baffles 18 of the output sheet cooling section 20 have their opposite ends fixed to the pair of pillars 42 and tilt upward on the front end side. The output sheet cooling section 20 waits for an image to be formed (printed) on a sheet by the image forming section 3 (S101 in FIG. 5). In order to start forming an image on a sheet in the image forming section 3, the control section 50 (FIG. 1) starts feeding the sheet by rotating the pickup roller 34 and paper feed roller pair 32 (S103). Then, the control section 50 rotates the blower fan 9. The blower fan 9 sends air from the far side to the near side of the output sheet stacking section 8. The baffles 18, which tilt upward, guides air from the blower fan 9 so as to blow against the ceiling 8*b*.

Figure 3A:
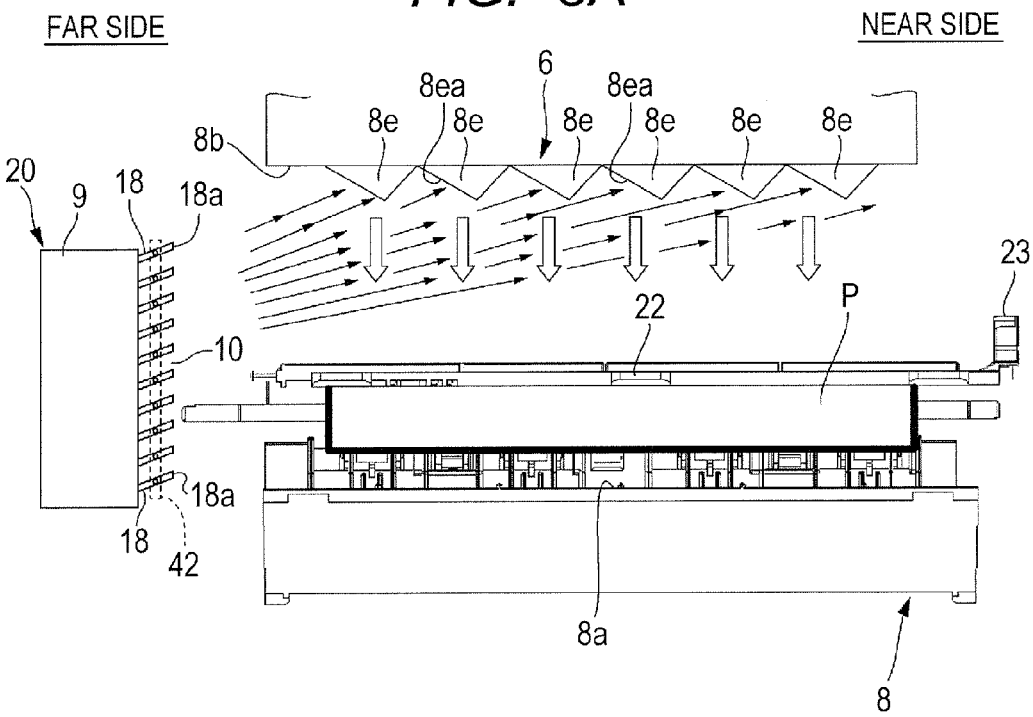
FIG. 3A is a sectional arrow view taken in the direction of line C-C in FIG. 1 when a sheet is being discharged onto the output sheet stacking section in the image forming apparatus of FIG. 1.
Figure 3B:
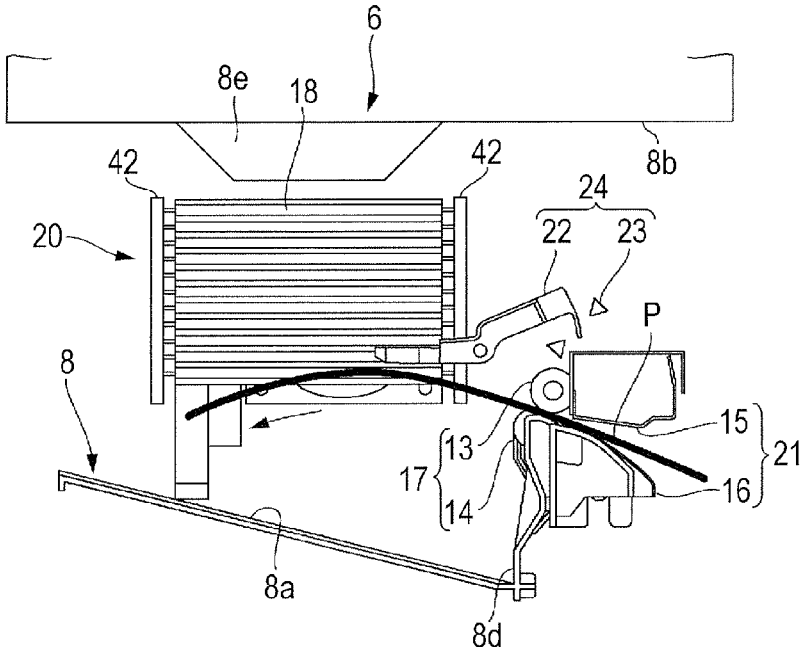
FIG. 3B is a right side view of FIG. 3A.

When a sheet on which a toner image has been fixed by fixing device 4 is carried in, the discharge section 5 sends out the sheet to the output sheet stacking surface 8*a* of the output sheet stacking section 8 using the discharge roller pair 17 (S105; FIGS. 3A and 3B). Consequently, the flag 22 turns by being pushed by the sheet. The turning of the flag 22 is sensed by the sensor 23 (S107).

Since the air from the blower fan 9 is directed at the ceiling 8*b*, the baffles 18 guide air to between the output sheet P discharged onto the output sheet stacking surface 8*a* (S109) and the ceiling 8*b* of the output sheet stacking section 8. Consequently, the output sheet cooling section 20 does not send the air from the blower fan 9 to under the output sheet being discharged by the discharge roller pair 17 and thus does not cause the output sheet to float up from the output sheet stacking surface 8*a*. Thus, the output sheet cooling section 20 can make it easier to load the sheet being discharged onto the output sheet stacking surface 8*a*.

The air coming from the blower fan 9 and blown against the reflecting surfaces 8*ea* of the ridges 8*e* is reflected, thereby dispersing and forcing out air stagnating in the output sheet stacking section 8. Consequently, the output sheet cooling section 20 can prevent the temperature of the output sheet stacking section 8 from being raised by heat from the sheet discharged into the output sheet stacking section 8 as well as from the toner image and cool the sheet and the toner of the toner image quickly with a reduced cooling time. Also, air is blown against the ridges 8*e* arranged on the ceiling 8*b*, offering the effect of cooling the image scanner 6 from below (from the bottom face) as well.

Then, the output sheet is discharged through the discharge roller pair 17. When the output sheet passes the discharge roller pair 17 (S111) and a rear end of the output sheet passes the flag 22, the flag 22 rotates to original position away from the sensor 23 by its own weight. The sensor 23 stops sensing the flag 22, and then turns off (S113).

In this way, after the sensor 23 senses the output sheet (S107), the output sheet cooling section 20 is designed to discharge air toward the ridges 8*e* for a predetermined period of time until the output sheet falls on the output sheet stacking surface 8*a* (S109, S111 and S113). That is, the output sheet cooling section 20 is designed to discharge air toward the ceiling 8*b* and ridges 8*e* at least from when the discharge section 5 discharges the rear end of the sheet until the sheet is loaded onto the output sheet stacking surface 8*a*.

The air discharged for the predetermined period of time is blown against the ridges 8*e* serving as an air guide. The reflecting surfaces 8*ea* inclined with respect to the ceiling 8*b* are formed on the ridges 8*e*. Therefore, air is reflected toward the output sheet stacking surface 8*a* by the reflecting surfaces 8*ea* of the ridges 8*e* and hits a top face of the output sheet from above the output sheet on which the toner image has been formed. Consequently, the air cools the output sheet and the toner of the toner image. Also, the air reflected by blowing against the reflecting surfaces 8*ea* of the ridges 8*e* presses against the top face of the output sheet and thereby helps the output sheet fall while at the same time cooling the falling sheet discharged toward the output sheet stacking surface 8*a* as well as the toner of the toner image on the output sheet. This prevents the output sheets P from being bonded to each other by the toner, and the output sheets are loaded quickly by being aligned neatly on the output sheet stacking surface 8*a* with reduced fall times.

The control section 50 determines whether or not there is any succeeding sheet. If there is any succeeding sheet (YES in S115), the control section 50 returns to the process of S103 and controls various components so as to repeat the above operation each time an output sheet is discharged onto the output sheet stacking section 8.

Figure 4A:
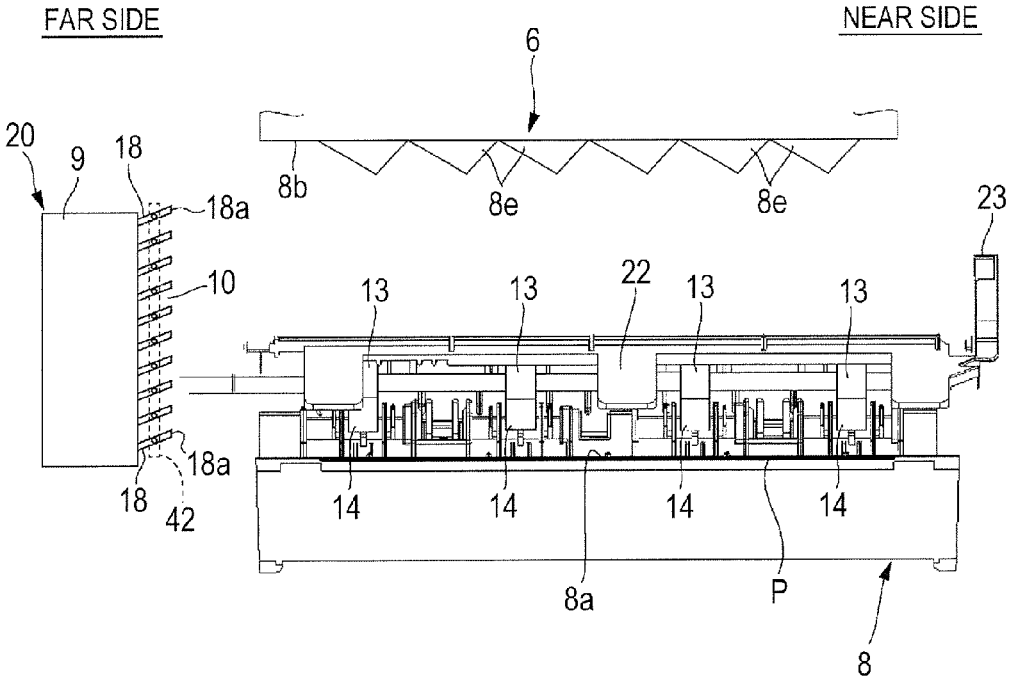
FIG. 4A is a sectional arrow view taken in the direction of line C-C in FIG. 1 when a sheet is loaded on the output sheet stacking section in the image forming apparatus of FIG. 1.
Figure 4B:
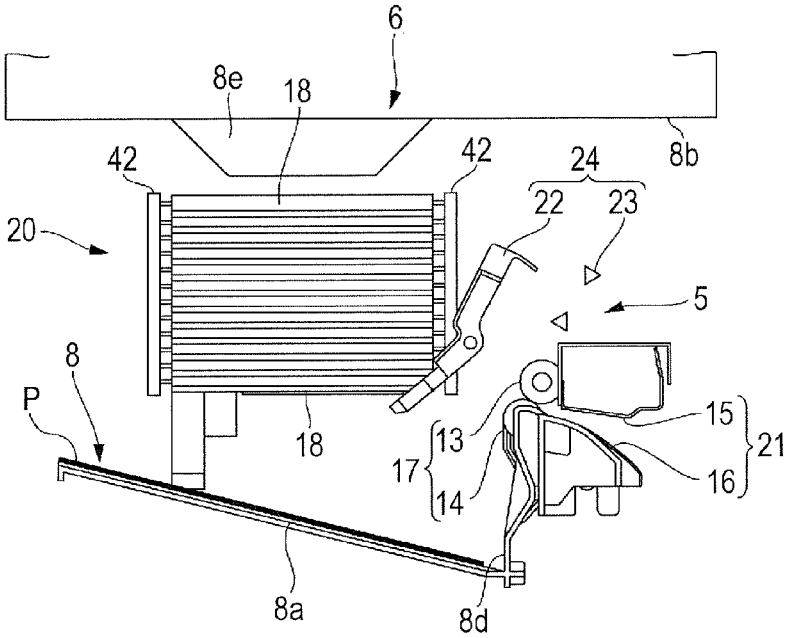
FIG. 4B is a right side view of FIG. 4A.

When there is no more sheet (NO in S115) and a predetermined time elapses after the last output sheet is discharged (S117), the control section 50 stops the blower fan 9 from rotating and finishes the image forming operation (FIGS. 4A and 4B).

In this way, while output sheets continue to be discharged onto the output sheet stacking section 8, the output sheet cooling section 20 continues rotating the blower fan 9 and directs the air from the blower fan 9 at the ridges 8*e* using the baffles 18. Consequently, the air reflected by the ridges 8*e* presses against the top face of the output sheet and thereby helps the output sheet fall while at the same time cooling the falling sheet discharged toward the output sheet stacking surface 8*a* as well as the toner of the toner image on the output sheet. This prevents the output sheets P from being bonded to each other by the toner, and the output sheets are loaded quickly on the output sheet stacking surface 8*a* with reduced fall times. Also, the air reflected by the ridges 8*e* can prevent the output sheets from floating up and improve the ease with which the sheets are loaded and aligned on the output sheet stacking surface 8*a*.

The output sheets loaded on the output sheet stacking surface 8*a* do not become higher than the discharge roller pair 17. Also, the blower fan 9, which is installed at a position higher than the discharge roller pair 17, will not blow air under upper output sheets even when a maximum number of output sheets are loaded on the output sheet stacking surface 8*a*.

(Image Forming Apparatus According to Second Embodiment)

Figure 6:
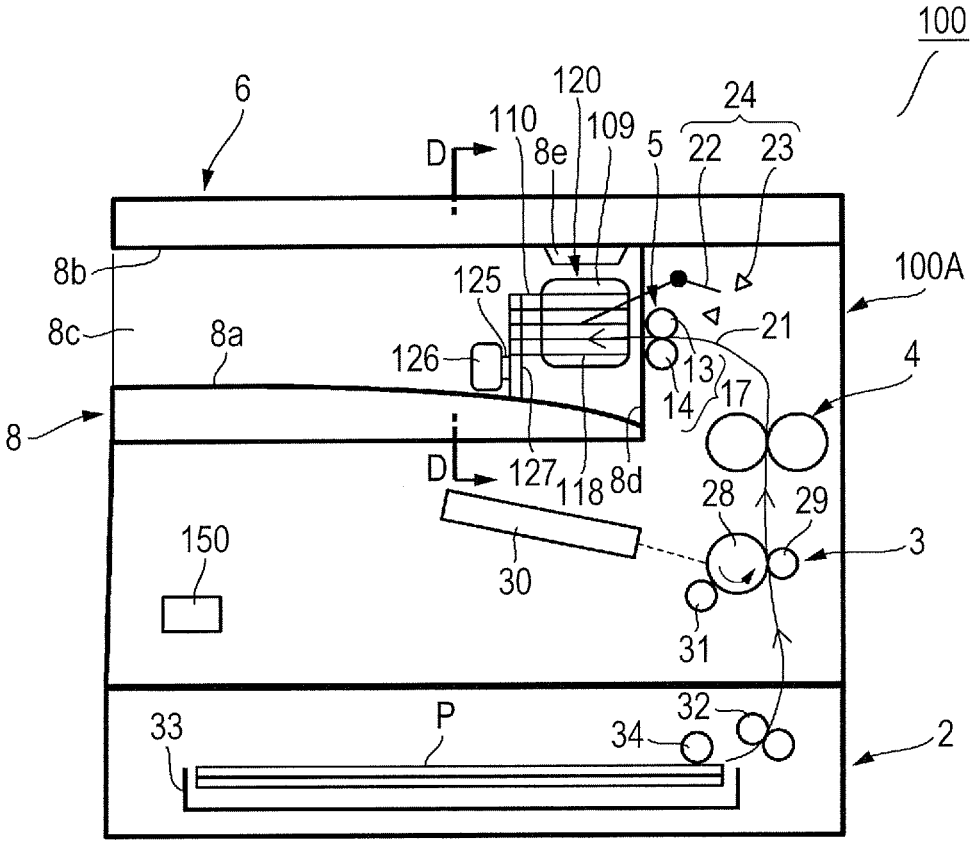
FIG. 6 is a schematic sectional view of an image forming apparatus according to a second embodiment of the present invention along a sheet conveying direction.
Figure 7A:
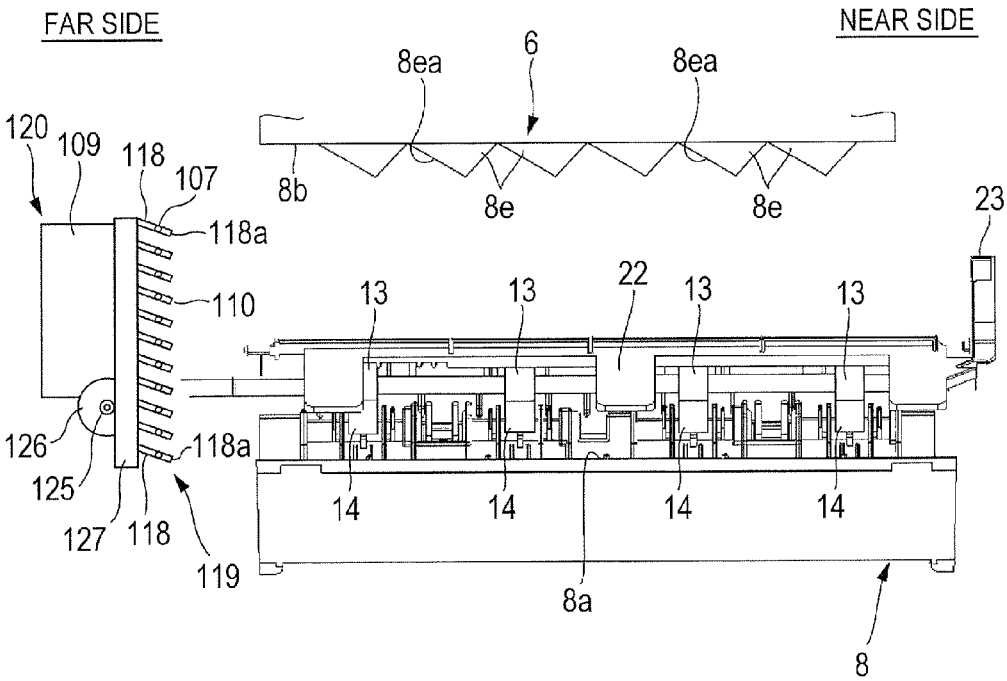
FIG. 7A is a sectional arrow view taken in the direction of line D-D in FIG. 6 when no sheet is sent to an output sheet stacking section in the image forming apparatus of FIG. 6.
Figure 7B:
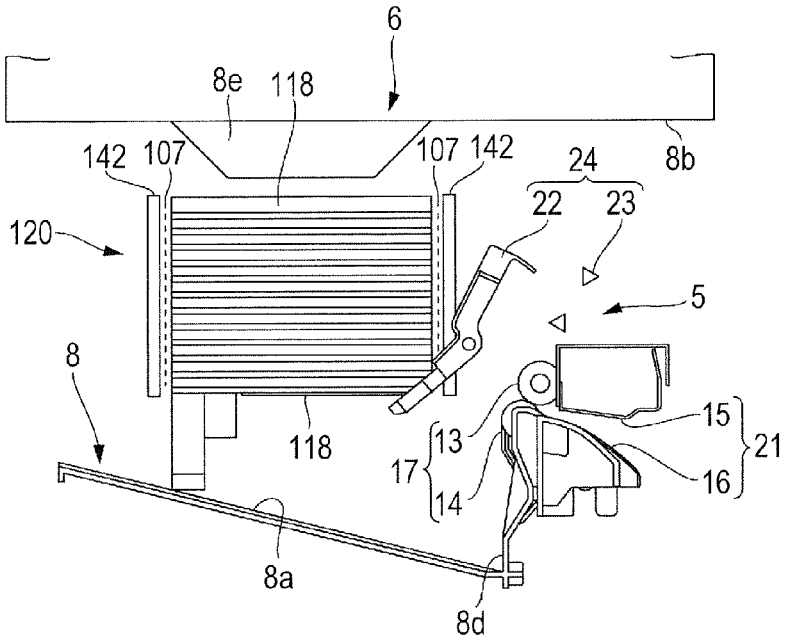
FIG. 7B is a right side view of FIG. 7A and a partially enlarged view of an output sheet cooling section in FIG. 6.
Figure 8A:
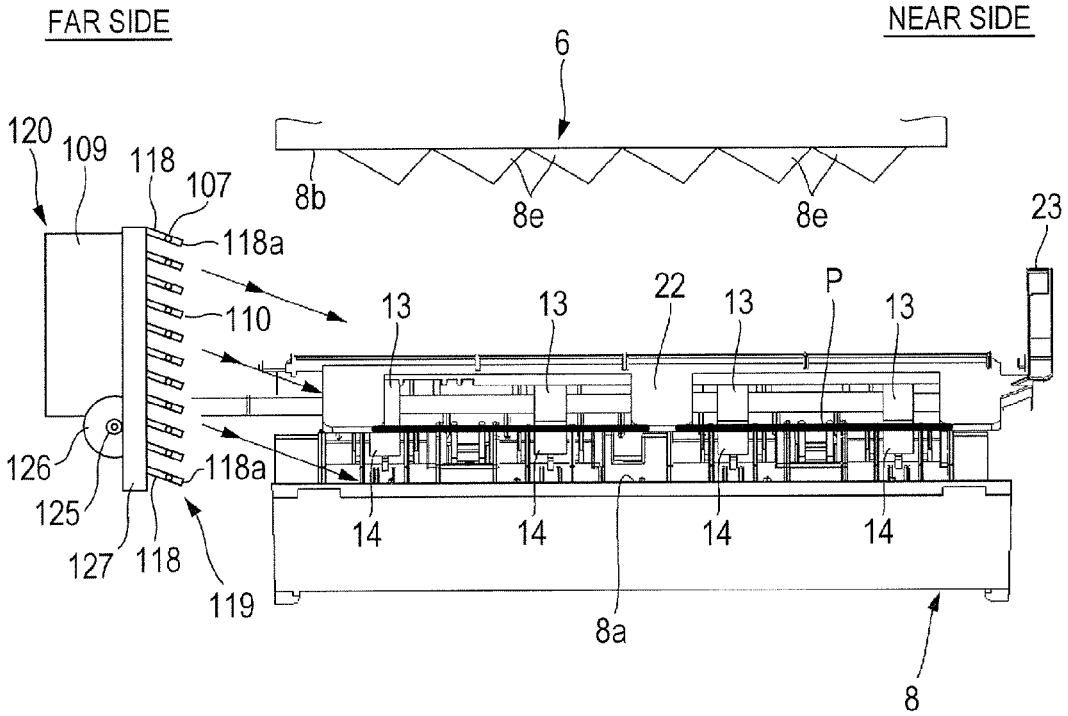
FIG. 8A is a sectional arrow view taken in the direction of line D-D in FIG. 6 when a sheet is sent to an entrance to the output sheet stacking section in the image forming apparatus of FIG. 6.
Figure 8B:
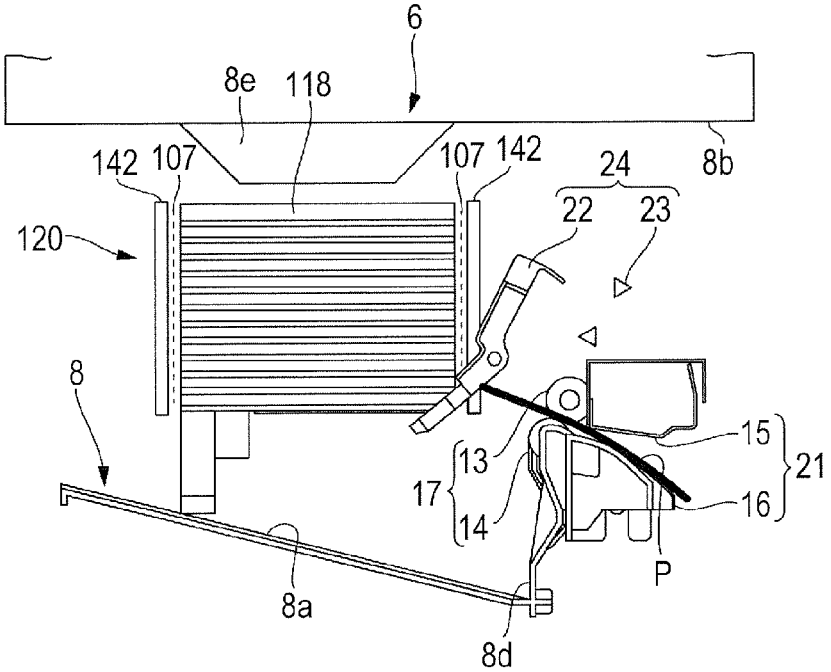
FIG. 8B is a right side view of FIG. 8A.
Figure 9A:
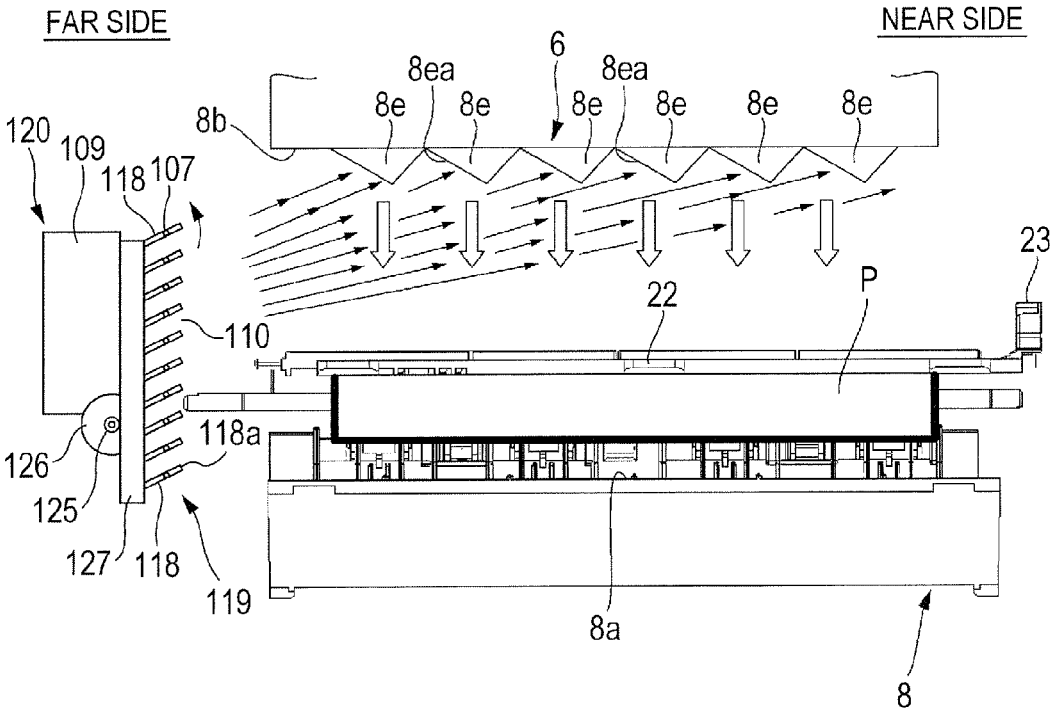
FIG. 9A is a sectional arrow view taken in the direction of line D-D in FIG. 6 when a sheet is being discharged onto the output sheet stacking section in the image forming apparatus of FIG. 6.
Figure 9B:
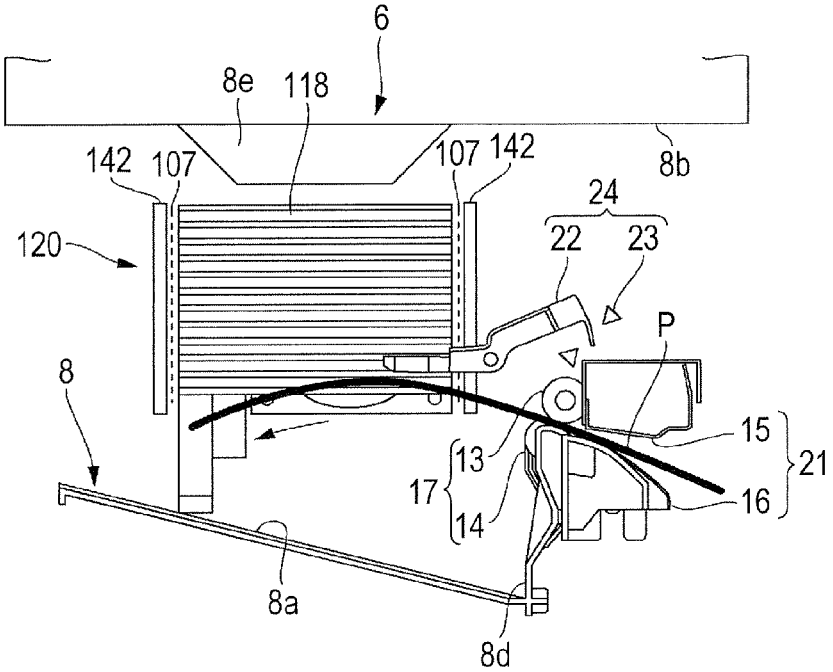
FIG. 9B is a right side view of FIG. 9A.
Figure 10A:
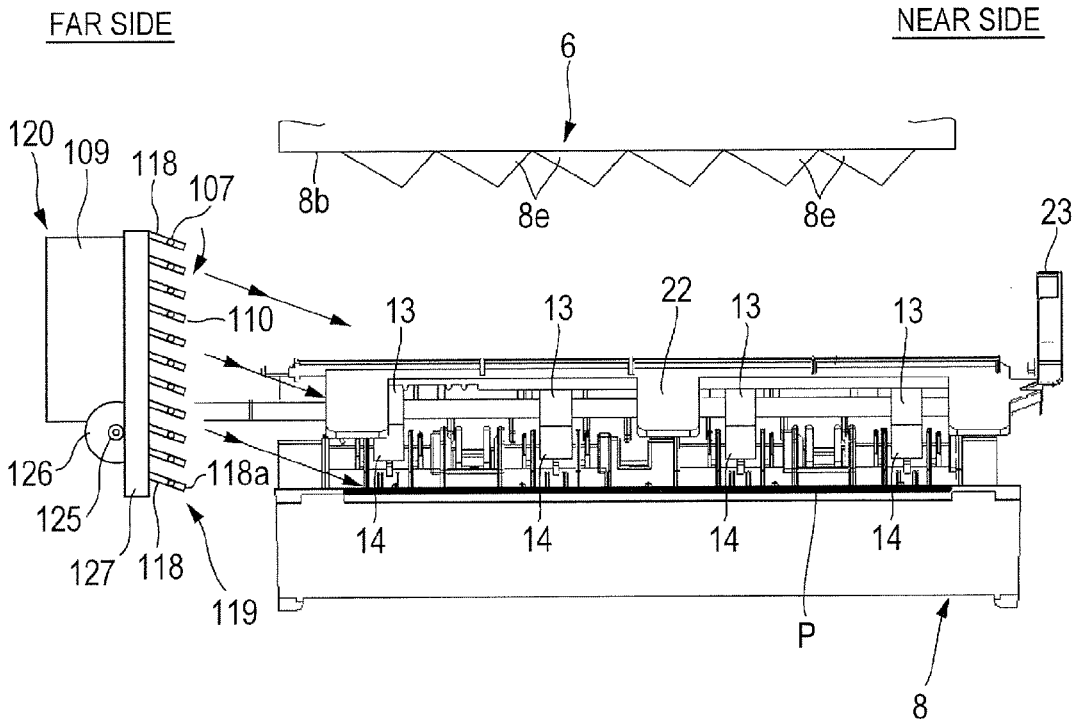
FIG. 10A is a sectional arrow view taken in the direction of line D-D in FIG. 6 when a sheet is loaded on the output sheet stacking section in the image forming apparatus of FIG. 6.
Figure 10B:
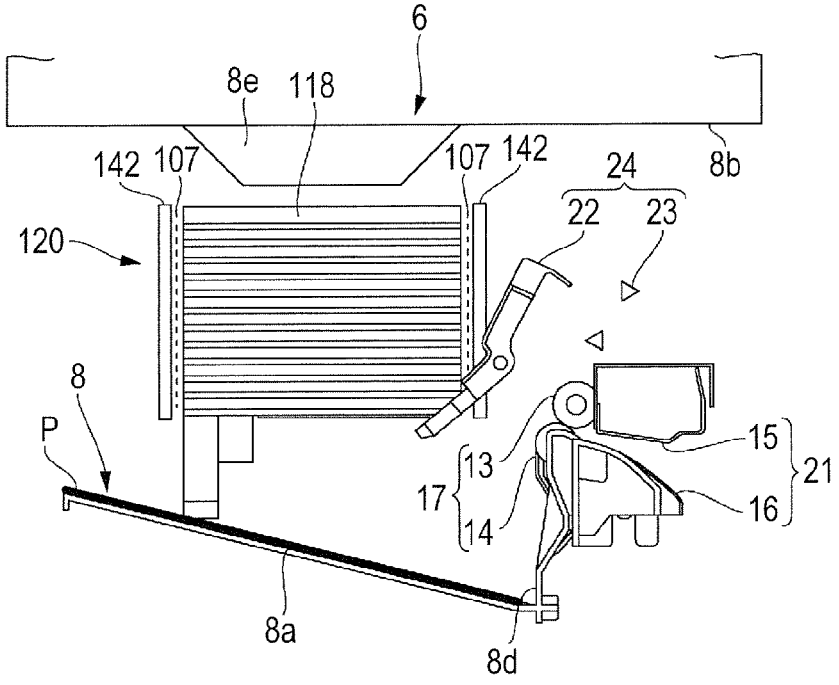
FIG. 10B is a right side view of FIG. 10A.
Figure 11:
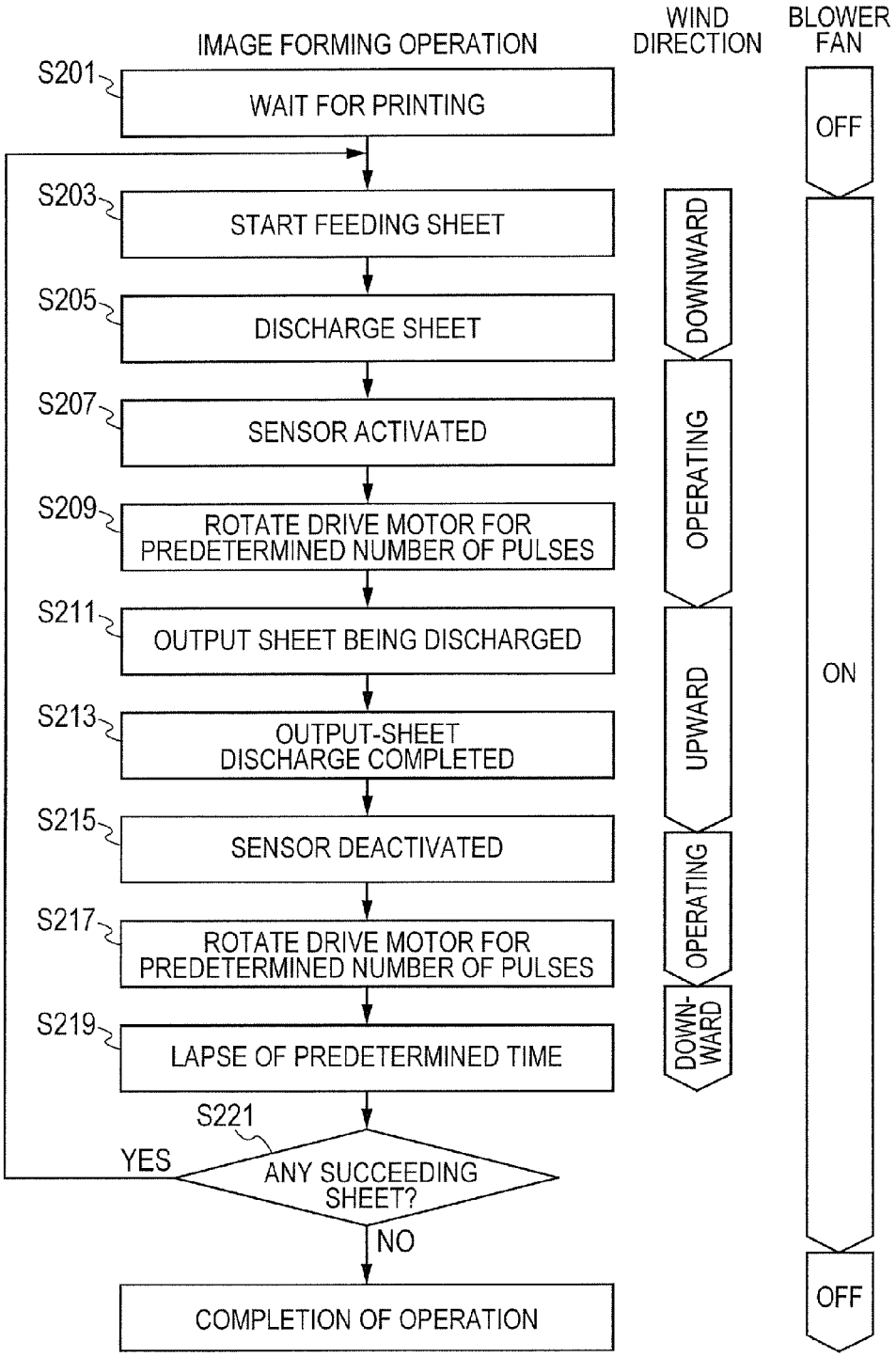
FIG. 11 is a flowchart for describing operation of the image forming apparatus shown in FIG. 6.

Next, an image forming apparatus according to a second embodiment of the present invention will be described below with reference to the drawings. FIG. 6 is a schematic sectional view of the image forming apparatus according to the second embodiment of the present invention along a sheet conveying direction. FIGS. 7A and 7B are diagrams illustrating a situation in which no sheet is sent to an output sheet stacking section in the image forming apparatus of FIG. 6. FIGS. 8A and 8B are diagrams illustrating a situation in which a sheet is sent to an entrance to the output sheet stacking section in the image forming apparatus of FIG. 6. FIGS. 9A and 9B are diagrams illustrating how a sheet is being discharged onto the output sheet stacking section in the image forming apparatus of FIG. 6. FIGS. 10A and 10B are diagrams illustrating how a sheet has been loaded on the output sheet stacking section in the image forming apparatus of FIG. 6. FIG. 11 is a flowchart for describing operation of the image forming apparatus shown in FIG. 6.

As with the image forming apparatus 1 according to the first embodiment, the image forming apparatus 100 according to the second embodiment is designed to form a toner image on a sheet based on image information about an original (not shown) scanned by the image scanner 6 or on image information transmitted from outside.

However, the image forming apparatus 100 according to the second embodiment differs from the image forming apparatus 1 according to the first embodiment in the structure of an output sheet cooling section. The output sheet cooling section 20 of the image forming apparatus 1 according to the first embodiment has the direction of the baffles 18 fixed, making the blowing direction of the blower fan 9 constant. In contrast, an output sheet cooling section 120 of the image forming apparatus 100 according to the second embodiment is designed to be able to change the tilt of baffles 118 using a drive motor 126 and thereby change the blowing direction of a blower fan 109 as shown in FIGS. 9A, 9B, 10A and 10B. Therefore, structural description of the image forming apparatus 100 according to the second embodiment will be limited to the output sheet cooling section 120 which differs from the image forming apparatus 1 according to the first embodiment while the same components as those in the first embodiment are denoted by the same reference numerals as the corresponding components in the first embodiment, and description thereof will be omitted.

The image forming apparatus 100 has a paper feeding section 2, an image forming section 3, a fixing device 4, a discharge section 5, the output sheet cooling section 120, an output sheet stacking section 8, the image scanner 6 and the like in an apparatus body 100A.

In FIGS. 6, 7A and 7B, the output sheet cooling section 120 serving as an air blowing unit is installed on the back wall 8*c* and designed to air-cool the sheets discharged onto the output sheet stacking surface 8*a* of the output sheet stacking section 8. Incidentally, although the back wall 8*c* is formed up to the left end of the apparatus body 100A in FIG. 6, the back wall 8*c* may be formed only where a blower fan 109 and baffles 118 of the output sheet cooling section 120 are installed.

The output sheet cooling section 120 includes the blower fan 109 and a wind direction switching section 119 which can switch the air direction of the blower fan 109 between the ceiling 8*b* and output sheet stacking surface 8*a* of the output sheet stacking section 8.

The blower fan 109 is installed on a near-side surface (front face) of the back wall 8*c* and designed to send air from the far side to the near side of the output sheet stacking section 8.

The wind direction switching section 119 serving as a wind direction switching unit includes, baffles 118 serving as flow guide members, a rack plate 127, a drive motor 126 and pinion 125.

A plurality of the baffles 118 are disposed (or a single baffle may be disposed) in a vertical direction on a front face (on the near side) of the blower fan 109 along the discharge direction of the sheets in the discharge section 5. The baffles 118 are rectangular plate members. A rotating shaft 107 is installed in a midsection between opposite ends of short sides of each baffle 118, protruding therefrom, so as to allow the baffle 118 to tilt in an up and down direction. The rotating shafts 107 are axially supported by support plates 142. The support plates 142 are installed on the back wall 8*c*, facing opposite ends of the baffles 118. The rack plate 127 is coupled to the far side of the baffles 118, pointing in the up and down direction. The drive motor 126 is installed on the back wall 8*c* behind the rack plate 127. The pinion 125 is installed on the drive motor 126. The pinion 125 is meshed with the rack plate 127. The front faces of the baffles 118 form air outlets 110 serving as air discharge ports.

Incidentally, in the wind direction switching section 119, a plunger (not shown) may be used instead of the drive motor 126. In that case, the rack plate is changed to a simple plate and the direction of the baffles 118 is changed by moving up and down the plate using the plunger, which eliminates the pinion. Therefore, the wind direction switching section 119 is not limited to the one described in the embodiment, and may have any configuration as long as the wind direction switching section 119 is configured to change the direction of the baffles 118.

The paper feeding section 2, image forming section 3, fixing device 4, discharge section 5, output sheet cooling section 120 and image scanner 6 are designed to operate under the control of a control section 150 (FIG. 6).

Next, operations of the discharge section 5, output sheet cooling section 120 and sheet detecting section 24 will be described mainly with reference to a flowchart in FIG. 11.

As shown in FIGS. 7A, 7B, 8A and 8B, the baffles 118 of the output sheet cooling section 120 normally have their front end portions 118*a* tilted downward (S201 in FIG. 11). The control section 150 (FIG. 6) starts feeding a sheet by rotating the pickup roller 34 and paper feed roller pair 32 (S203) and rotates the blower fan 109. The blower fan 109 sends air from the far side to the near side of the output sheet stacking section 8. The baffles 118, which tilt downward, guides air from the blower fan 109 so as to blow against the output sheet stacking surface 8*a*.

When a sheet on which a toner image has been fixed by fixing device 4 is carried in, the discharge section 5 sends out the sheet to the output sheet stacking surface 8*a* of the output sheet stacking section 8 using the discharge roller pair 17 (S205; FIGS. 8A and 8B). Consequently, the flag 22 turns by being pushed by the sheet. The turning of the flag 22 is sensed by the sensor 23 (S207).

When a predetermined time elapses after the sensor 23 senses the flag 22, the control section 150 rotates the drive motor 126 a predetermined number of times. The rotation of the drive motor 126 is sensed as the control section 150 counts a predetermined number of pulses (S209 and S211). The drive motor 126 rotates the pinion 125 and thereby moves down the rack plate 127. As the rack plate 127 moves down, the front end portions 118*a* of the baffles 118 tilt upward around the rotating shafts 107 (FIGS. 9A and 9B).

Consequently, the baffles 118 guide the air from the blower fan 109 to between the output sheet P discharged onto the output sheet stacking surface 8*a* and the ceiling 8*b* of the output sheet stacking section 8 such that the air will be blown against the ceiling 8*b*. Therefore, the air from the blower fan 109 does not get under the output sheet and thus does not cause the output sheet to float up. Thus, the output sheet cooling section 120 improves the ease with which the sheets are loaded onto the output sheet stacking surface 8*a*. That is, the air existing between sheets can be reduced.

Also, the air blown against the ceiling 8*b* from the blower fan 109 changes direction at the ceiling 8*b* and hits the top face of the output sheet on which the toner image has been formed. A plurality of the ridges 8*e* are provided on the ceiling 8*b*, protruding therefrom. The air blowing against the reflecting surfaces 8*ea* of the ridges 8*e* is reflected toward the output sheet stacking section 8 and is caused to change its flow. The air cools the output sheet and the toner of the toner image. Also, the air reflected by the reflecting surfaces 8*ea* of the ridges 8*e* presses against the top face of the output sheet falling on the output sheet stacking surface 8*a* and thereby helps the output sheet fall. Consequently, the output sheets P are loaded quickly on the output sheet stacking surface 8*a* with reduced fall times.

Furthermore, the air blown against the ridges 8*e* from the blower fan 109 changes direction, thereby dispersing and forcing out air stagnating in the output sheet stacking section 8. Consequently, the output sheet cooling section 120 can prevent the temperature of the output sheet stacking section 8 from being raised by heat from the sheet discharged into the output sheet stacking section 8 as well as from the toner image and cool the sheet and toner of the toner image quickly with a reduced cooling time.

When the rear end of the output sheet passes the discharge roller pair 17 (S213) and then the flag 22, the flag 22 rotates to original position away from the sensor 23 by its own weight. After the sensor 23 ceases to sense the flag 22 (S215), when the output sheet is loaded on the output sheet stacking section by falling thereon, the control section 150 rotates the drive motor 126 in a reverse direction a predetermined number of times (S217). The drive motor 126 rotates the pinion 125 in a reverse direction, moving up the rack plate 127. As the rack plate 127 moves up, the front end portions 118*a* of the baffles 118 tilt downward around the rotating shafts 107 (FIGS. 10A and 10B).

In this way, after the sensor 23 senses the output sheet (S207), the output sheet cooling section is designed to discharge air toward the ridges 8*e* for a predetermined period of time (S209 and 5211) and then discharge air toward the output sheet on the output sheet stacking surface (S217 and S219). That is, the output sheet cooling section 120 discharges air toward the ceiling 8*b* and ridges 8*e* at least from when the discharge section 5 discharges the rear end of the sheet until the sheet is loaded onto the output sheet stacking surface 8*a*. Subsequently, the output sheet cooling section 120 is designed to change the airflow direction from the ceiling 8*b* to the output sheet stacking surface 8*a*.

When a predetermined time elapses after the output sheet is loaded onto the output sheet stacking surface 8*a* (S219), the control section 150 determines whether or not there is any succeeding sheet (S221). If there is any succeeding sheet (YES in S221), the control section 150 returns to the process of S203 and controls various components so as to repeat the above operation each time an output sheet is discharged onto the output sheet stacking section 8. When the paper feed roller pair 32 finishes feeding sheets and the last output sheet is discharged and loaded onto the output sheet stacking section 8 (NO in S221), the control section 150 stops the operation of the image forming apparatus.

As described above, the baffles 118 guide the air from the blower fan 109 to the top face of the output sheet loaded on the output sheet stacking surface 8*a* and blows the air against the top face of the output sheet. Consequently, the output sheet cooling section 120 can directly cool the top face of the sheet being discharged with the air from the blower fan 109 and cool the output sheet and the toner of the toner image with a reduced cooling time. This prevents output sheets from being bonded to each other even if succeeding output sheets are loaded on preceding output sheets.

Furthermore, since the output sheet cooling section blows the air from the blower fan 109 directly against the top face of the output sheets, the output sheet cooling section can prevent the output sheets from floating up and improve the ease with which the sheets are loaded and aligned on the output sheet stacking surface 8*a*.

Although the direction of air is changed by the baffles 118 in the above description, two blower fans may be used instead of using the baffles 118, one of the blower fans discharging air toward the ceiling and the other blower fan blowing air against the output sheet loaded on the output sheet stacking surface 8*a*.

Incidentally, the output sheets loaded on the output sheet stacking surface 8*a* do not become higher than the discharge roller pair 17. Also, the blower fan 109, which is installed at a position higher than the discharge roller pair 17, will not blow air under upper output sheets even when a maximum number of output sheets are loaded on the output sheet stacking surface 8*a*.

Although a plurality of the ridges 8*e* are arranged according to the first and second embodiments, a single ridge may be installed alternatively. Also, although the downward-looking protrusions are uniform in height, the protrusions may be gradually increased in height with increasing distance from the air outlets 10 (110). Besides, instead of providing the plurality of ridges 8*e*, that part of the ceiling on which a ridge is provided may be configured to be a sloped surface (reflecting surface) which approaches the output sheet stacking surface 8*a* with increasing distance from the air outlet 10 (110). Therefore, the air guide is not limited to ridges, and may have any shape which serves to change the direction of air to the output sheet stacking surface 8*a* after the air is discharged from the air outlet 10 (110) toward the ceiling. Thus, if the bottom face of the image scanner 6 is used as the ceiling 8*b* of the output sheet stacking section, projections and depressions on the bottom face of the image scanner 6 may be used as the air guide.

Incidentally, even if the ceiling is flat without installation of an air guide, the air from the air outlets (110) is designed to change its direction to the output sheet stacking surface 8*a* by obliquely hitting the ceiling 8*b* as shown in FIGS. 3A and 9A. However, the installation of an air guide allows the direction of air to be changed actively, offering an improved cooling effect as well as an improved effect of facilitating the fall of sheets.

Furthermore, a reverse conveyance path for duplex paper output is sometimes installed below the ceiling, and the ridges described above may be installed on the back side of the reverse conveyance path for duplex paper output, facing the output sheet stacking surface.

Incidentally, the output sheet cooling section 120 of the image forming apparatus 100 according to the second embodiment may cool the output sheets with the baffles 118 kept facing upward as shown in FIGS. 9A and 9B without rotating the drive motor 126. This will achieve effects similar to those of the image forming apparatus 1 according to the first embodiment.

With the image forming apparatus according to the present invention, since the air blowing unit directs air toward the ceiling, air can be sent to between the sheet and ceiling and the direction of air can be changed to the output sheet stacking unit positioned below the ceiling by reflecting the air on the ceiling.

Consequently, since the image forming apparatus according to the present invention blows air from above the sheet while keeping the sheet which is loaded on a sheet stacking unit from being blown off or floating up, the image forming apparatus helps the sheet to fall on the sheet stacking surface and loads the sheet onto the sheet stacking surface quickly in a short time, improving the ease with which the sheets are loaded and aligned on the output sheet stacking surface. Also, since air is circulated between the sheet stacking unit and ceiling, lowering the temperature of space between the sheet stacking unit and ceiling as well as lowering the temperature of the sheet itself by cooling the sheet, the image forming apparatus according to the present invention can prevent sheets from being bonded to each other by the toner of the toner image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-104363, filed May 1, 2012, and No. 2013-032136, filed Feb. 21, 2013, which are hereby incorporated by reference herein in their entirety.

What is claimed is:

1. An image forming apparatus comprising:

a discharge unit adapted to discharge a sheet with a toner image fixed thereon by heat;

a sheet stacking unit on which the sheet discharged from the discharge unit is loaded;

a cover unit provided facing the sheet stacking unit so as to cover an upper surface of the sheet stacking unit;

an air blowing unit adapted to blow air toward the cover unit, and a reflecting unit provided on the cover unit and adapted to reflect the air blown toward the cover unit by the air blowing unit to the sheet discharged from the discharge unit.

2. The image forming apparatus according to claim 1, wherein the air blowing unit includes an air flow direction switching unit adapted to switch an airflow direction from the cover unit to the sheet stacking unit.

3. The image forming apparatus according to claim 2, wherein from when the discharge unit discharges a rear end of the sheet until the sheet is loaded onto the sheet stacking unit, the air flow direction switching unit positions the air blowing unit at a position where the air is directed at the cover unit.

4. The image forming apparatus according to claim 2, further comprising a detecting unit adapted to detect the sheet discharged onto the sheet stacking unit, wherein from when the detecting unit detects a sheet until the sheet is loaded onto the sheet stacking unit, the air flow direction switching unit positions the air blowing unit at a position where the air is directed at the cover unit.

5. The image forming apparatus according to claim 1, wherein the discharge unit is positioned lower than the air blowing unit.

6. The image forming apparatus according to claim 1, wherein the air blowing unit directs the air to the reflecting unit so that the reflecting unit reflects the air to guide the air to the sheet stacking unit.

7. The image forming apparatus according to claim 1, wherein the reflecting unit includes a projection projecting towards the sheet stacking unit.

8. The image forming apparatus according to claim 1, wherein the reflecting unit includes a plurality of projections projecting toward the sheet stacking unit.

9. The image forming apparatus according to claim 1, wherein the reflecting unit includes a plurality of projections projecting toward the sheet stacking unit, and wherein projection amounts of the projections are successively larger in accordance with an increasing distance between the respective projection and the air blowing unit.

10. The image forming apparatus according to claim 1, wherein the reflecting unit includes a sloped surface that slopes so as to approach the sheet stacking unit with increasing distance from the air blowing unit and provided on the cover unit provided above the sheet stacking unit so as to face the sheet stacking unit.

11. The image forming apparatus according to claim 1, wherein the reflecting unit is a bottom surface of an image reading apparatus that reads an image of an original.

* * * * *